US007361060B2

(12) United States Patent
Russelburg

(10) Patent No.: US 7,361,060 B2
(45) Date of Patent: Apr. 22, 2008

(54) CONNECTOR WITH BIFURCATED CONDUCTOR

(75) Inventor: Kevin L. Russelburg, Lemont, IL (US)

(73) Assignee: Illinois Tool Works Inc, Glenview, IL (US)

( * ) Notice: Subject to any disclaimer, the term of this patent is extended or adjusted under 35 U.S.C. 154(b) by 0 days.

(21) Appl. No.: 11/495,424

(22) Filed: Jul. 28, 2006

(65) Prior Publication Data

US 2007/0032111 A1 Feb. 8, 2007

Related U.S. Application Data

(60) Provisional application No. 60/705,375, filed on Aug. 4, 2005.

(51) Int. Cl.
*H01R 24/00* (2006.01)

(52) U.S. Cl. ..... 439/660

(58) Field of Classification Search ..... 439/660, 439/66, 630–635, 862
See application file for complete search history.

(56) References Cited

U.S. PATENT DOCUMENTS 6,053,776 A * 4/2000 Bricaud et al. ..... 439/630
6,152,790 A * 11/2000 Morris ..... 439/862
6,315,621 B1 * 11/2001 Natori et al. ..... 439/862
6,764,315 B2 * 7/2004 Ng et al. ..... 439/66
6,793,533 B2 9/2004 Berg et al.
6,811,433 B2 11/2004 Jou
6,827,586 B2 12/2004 Noda et al.
6,827,610 B2 12/2004 Lin
6,830,469 B1 12/2004 Doyle et al.
6,848,492 B2 2/2005 Thomas
6,851,986 B2 2/2005 Zhao
2005/0239333 A1 * 10/2005 Watanabe et al. ..... 439/630

FOREIGN PATENT DOCUMENTS

EP 1065754 2/2001
EP 1162699 12/2001

* cited by examiner

*Primary Examiner*—Ross N Gushi
(74) *Attorney, Agent, or Firm*—Mark W. Croll; Paul F. Donovan

(57) ABSTRACT

A connector block is provided with a plurality of channels. Separating the channels are ribs and conductors are mounted in the channels. The conductors may each include a soldering region for joining with a surface conductor and a contact region for joining with conductors on a mating connector block. The contact region may include a conductor that is bifurcated. The rib positioned between adjacent channels acts as a shield and may extend below the soldering region of the conductors so as to prevent solder from adjacent conductors from inadvertently forming a short.

12 Claims, 6 Drawing Sheets

CONNECTOR WITH BIFURCATED CONDUCTOR

CROSS REFERENCE TO RELATED APPLICATIONS

This Non-Provisional Application claims benefit to U.S. Provisional Application Ser. No. 60/705,375 filed Aug. 4, 2005.

FIELD OF THE INVENTION

The present invention relates to the field of connectors and more particularly to the field of electrical connectors.

BACKGROUND OF THE INVENTION

A printed circuit board (PCB) is commonly used as a substrate for electrical circuitry. As is known, electrical components may be surface mounted on a PCB in a desired configuration and connected as desired with traces so as to provide the desired circuitry. The functionality of the circuitry can range from something relatively complex like a motherboard for a computer to a simple circuit that includes just one or two electrical components.

In order to provide electrical communication between the circuitry on the PCB and other components not on the PCB, wires may be soldered to conductors provided on a surface of the PCB. However, another possible method of providing electrical communication with the circuitry on the PCB is to mount a connector on the PCB that is in electrical communication with the circuitry. Then, a mating connector can be attached to the mounted connector. This is helpful if multiple wires are to be attached to the circuitry on the PCB. For example, the mounted connector may include a number of conductors connected to circuitry on the PCB and these conductors may be coupled to other components (which may be external to the PCB) by simply installing the mating connector on the mounted connector. In other words, a number of conductors can be coupled together by performing one operation (joining two connectors together), and for example, the circuitry on two separate PCBs can be conveniently brought into electrical communication.

While the use of mating connectors is known, certain problems can exist. When mounting a connector with a number of conductors on the PCB, the conductors in the connector can be soldered to surface conductors on the PCB. If the conductors in the connector are soldered to the surface conductors on the PCB, it is possible that solder melted by the soldering action may inadvertently bridge two conductors that were not intended to be in electrical communication, potentially causing the circuitry or the connector (or both) to short out, possibly causing the entire circuitry to become waste. Furthermore, the respective conductors in the mating connector and mounted connector sometimes get damaged or have trouble forming a desirable electrical connection because one of the conductors in one of the connectors becomes contaminated by dirt or corrosion or other contaminants that prevent the conductors from the two connectors from forming the electrical connection. Furthermore, vibrations can cause the electrical connection between respective conductors in mating connectors to become intermittent, especially if one or both suffers from some degree of contamination. Therefore, improvements to known connectors would be beneficial.

SUMMARY OF THE INVENTION

In an embodiment, a connector block is provided with a plurality of channels. Mounted in the channels are conductors. The conductors may each include a soldering region proximal a bottom of the connector block and a contact region proximal a top of the connector block. A rib positioned between adjacent channels acts as a shield and may extend below the soldering region of the conductors so as to prevent solder from adjacent conductors from inadvertently forming a short. An alignment feature may be used to align the connector block with a mounting surface.

Other features and advantages of the invention will become apparent to those skilled in the art upon review of the following detailed description, claims and drawings in which like numerals are used to designate like features.

DETAILED DESCRIPTION OF THE EMBODIMENTS

Printed circuit boards (PCB) are commonly used to package electrical circuitry and may be formed by a number of different processes. While other methods exist to provide circuitry and PCBs have certain developmental costs, PCBs have advantages with respect to reliability and piece cost and therefore are commonly used in conjunction with higher volume production. For example, a module, which provides some desired functionality, can be provided on a PCB and due to economics of scale, the module can be reproduced relatively inexpensively compared to other methods of providing the functionality of the module. As can be appreciated, the module can be sold as is or one or more modules may be mounted in a housing and sold as a product.

Sometimes a module may include a plurality of inputs and/or outputs. As can be appreciated, if a number of wires or conductors are needed in order to provide the needed input to and/or receive the desired output from the module, the cost of connecting each conductor can raise the price of the module substantially as well as reduce the overall reliability of the module; sometimes making the module less economically desirable. Therefore, a connector may be mounted to the module so as to provide a convenient method of coupling the module to other components. As the use of connectors on a module is a common design choice, an improved method of mounting a connector to a module may provide a substantial economic benefit. Furthermore, if it is desirable to automatically connect and disconnect to the circuitry provided by the module, it may be beneficial to have a single connector with a set of conductors so that a single operation can couple a set of conductors in a desired manner.

Figure 1:
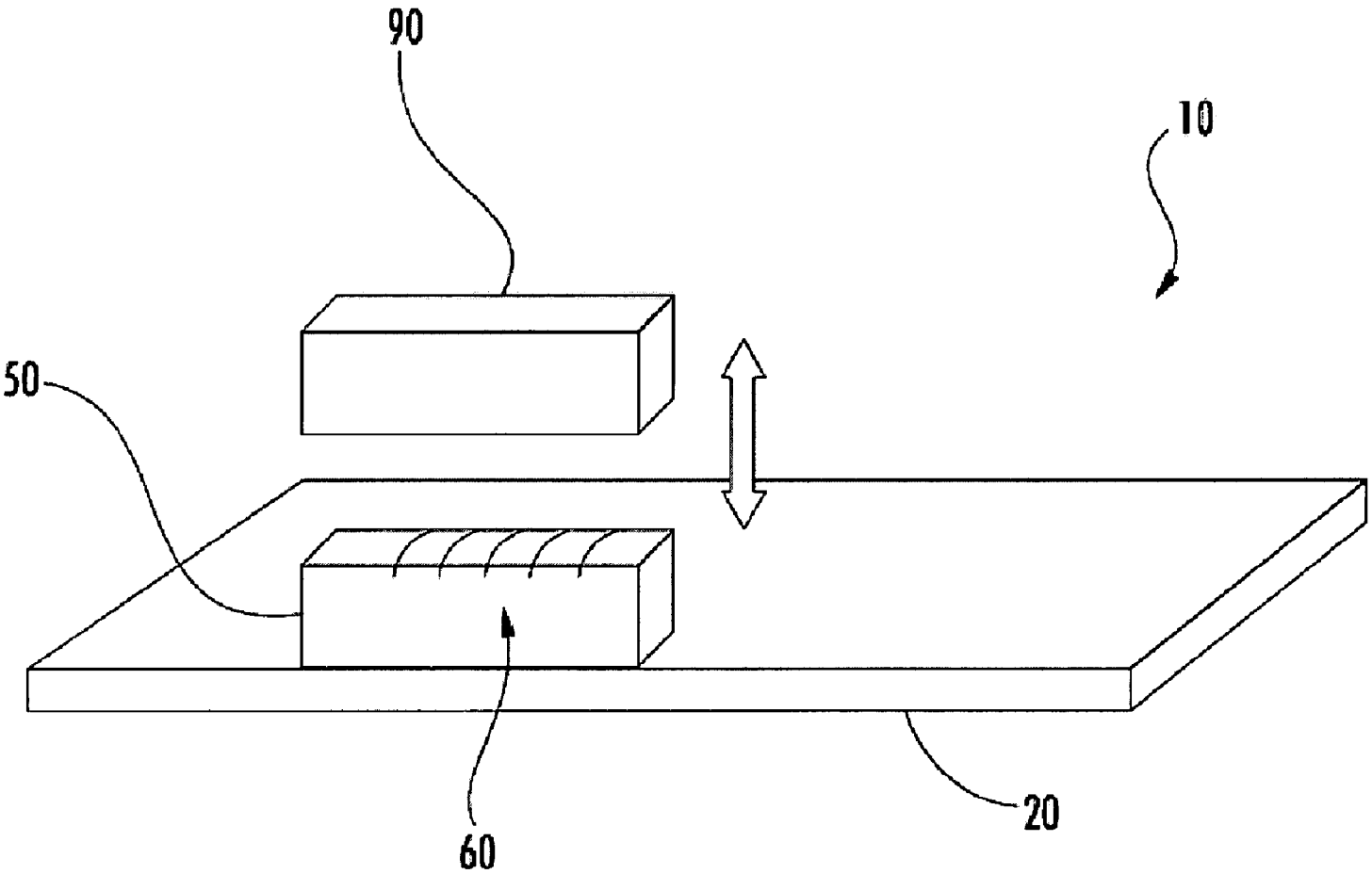
FIG. 1 is a schematic view of an embodiment of a mounted connector and a mating connector.
Figure 2:
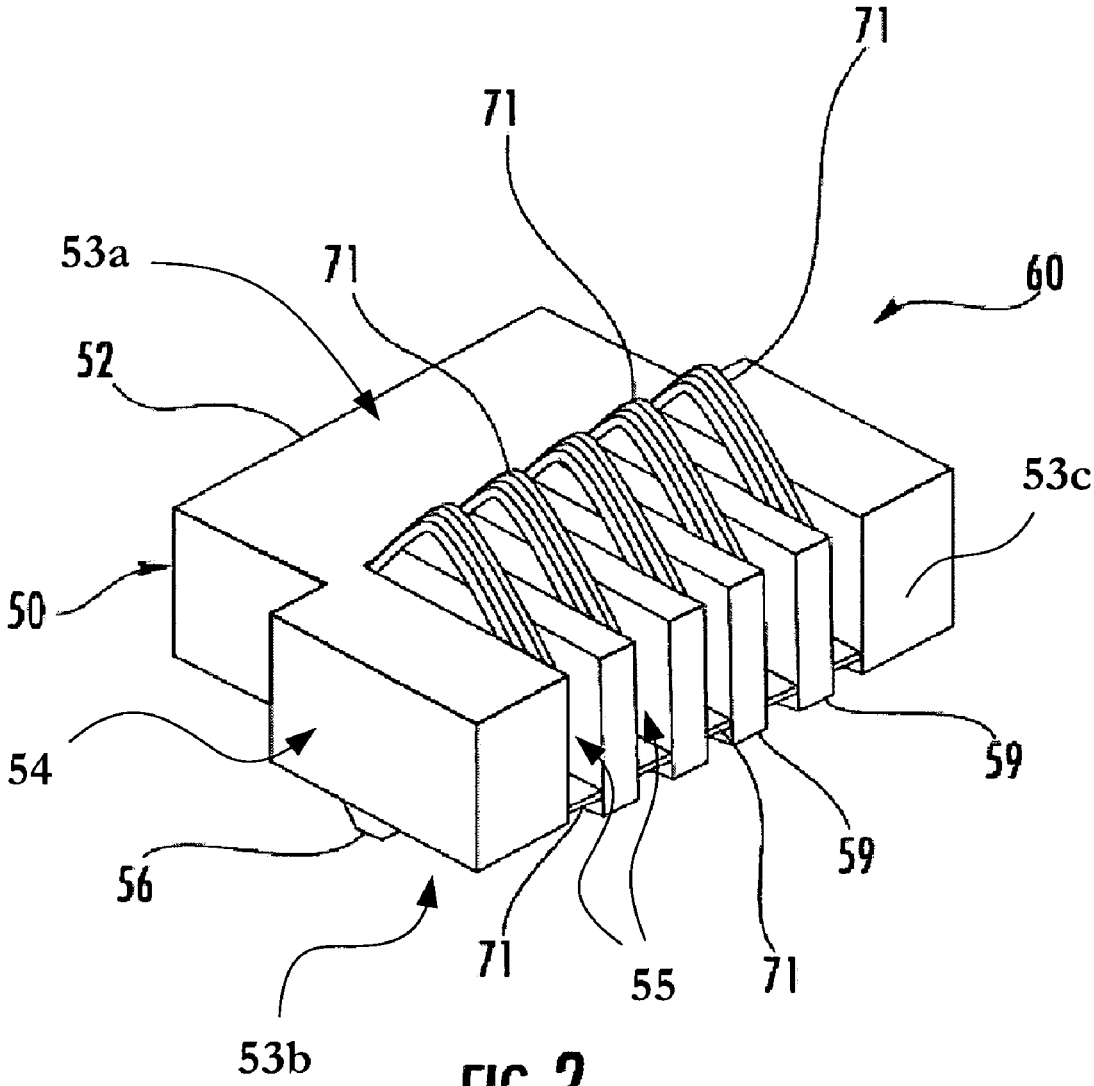
FIG. 2 is an isometric view of an embodiment of a connector.
Figure 3:
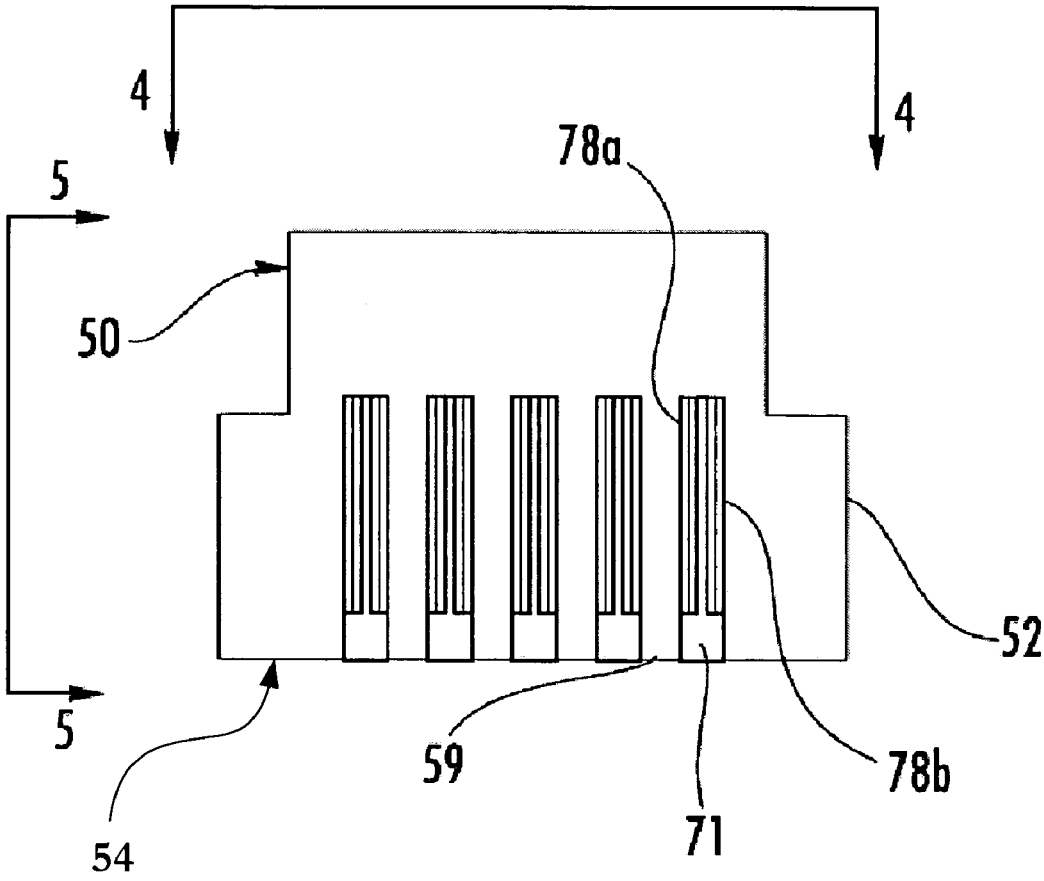
FIG. 3 is a plan view of an embodiment of a connector similar to the connector depicted in FIG. 2.

Looking at FIG. 1, a schematic of a printed circuit assembly 10 is provided. As depicted, a connector 50 with a conductor set 60 is surface mounted to a PCB 20. The PCB 20, which is an example of a mounting surface, may be populated with one or more electrical components (not shown) such as resistors, capacitors, logic blocks and the like. The resultant circuitry can be as complex or as straightforward as is appropriate for the given purpose of the resultant module. In operation, a mating connector 90 can be coupled to the connector 50 so as allow the module to receive the desired inputs and outputs.

It should be noted that in an embodiment where the connector 90 is automatically adjustable between an engaged position and a disengaged position, a signal passed through one or more of the conductors 60 of the connector 50 can cause the connector 90 to be moved to the disengaged position, as depicted in FIG. 1. In such a system, an intermittent connection would be problematic because it is possible that the signal indicating the need for separation might not be delivered as intended.

Turning to FIGS. 2-5, various views are provided of embodiments of a connector that may be mounted to surface, such as the surface of a PCB. As depicted, the connector 50 includes the conductor set 60 mounted in a block 52. The block 52 includes a first side 53*a*, a second side 53*b* and a third side 53*c*. The third side 53*a* includes a plurality of channels 55 and is part of the perimeter 54. As can be appreciated, the perimeter 54 may be configured so that a corresponding shaped mating connector will only be able to engage the connector 50 in one orientation. To ease assembly of the mating connector, the corners of the perimeter 54 near the first side 53*a* may include a desired radius so as to improve ease of assembly.

Figure 7:
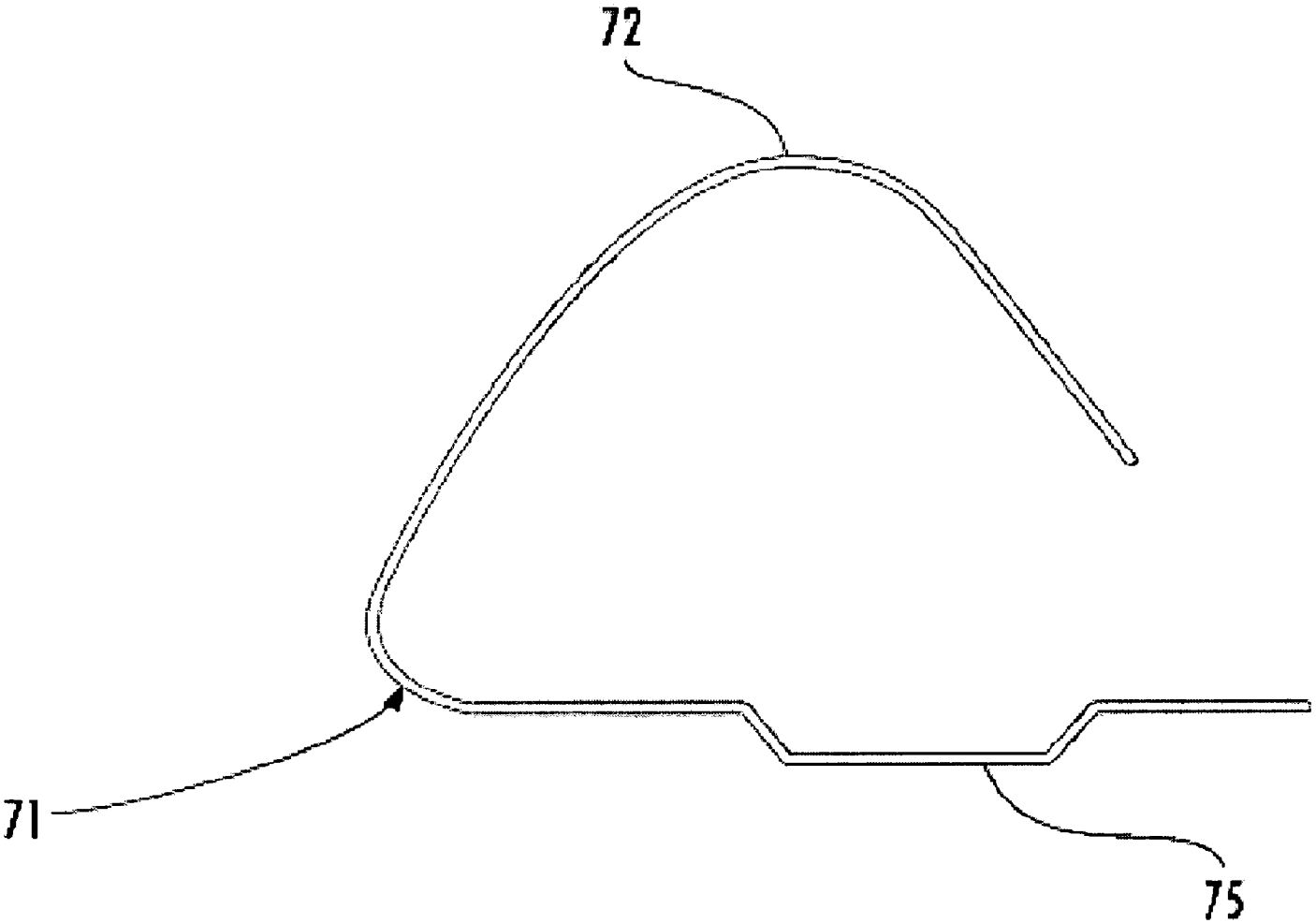
FIG. 7 is a cross section view of an embodiment of a stamped conductor.

Separating the channels 55 are ribs 59 that may be configured to act as shields. As depicted, a conductor 71 is positioned in each of the channels 55 and the conductors 71 extend above the first side 53*a*. In an embodiment the conductor 71 is shaped substantially as shown in FIG. 7 and includes a contact region 72 and a soldering region 75. When the connector 50 is mounted to a surface, the soldering region 75 of the conductor 71 can be brought into contact with a solder pad on the surface and the conductor 71 may then be soldered in a known manner. In the embodiment, the soldering region 75 of the conductors 71 does not extend below the second side 53*b* and the ribs are substantially flush with the second side 53*b*. Thus, when the connector 50 is mounted to a surface, the ribs 59 are substantially flush with the surface. As can be appreciated, this allows the ribs 59 to act as shields when the soldering region 75 of the conductors 71 is soldered to a surface conductor, not shown, and helps prevent the melted solder from bridging adjacent conductors.

It should be noted that a conductor 71 need not be positioned in each channel 55. Furthermore, while the channels 55 are depicted as being substantially the same size, larger and smaller channels 55 (with respectively configured conductors 72) may also be used.

Figure 4:
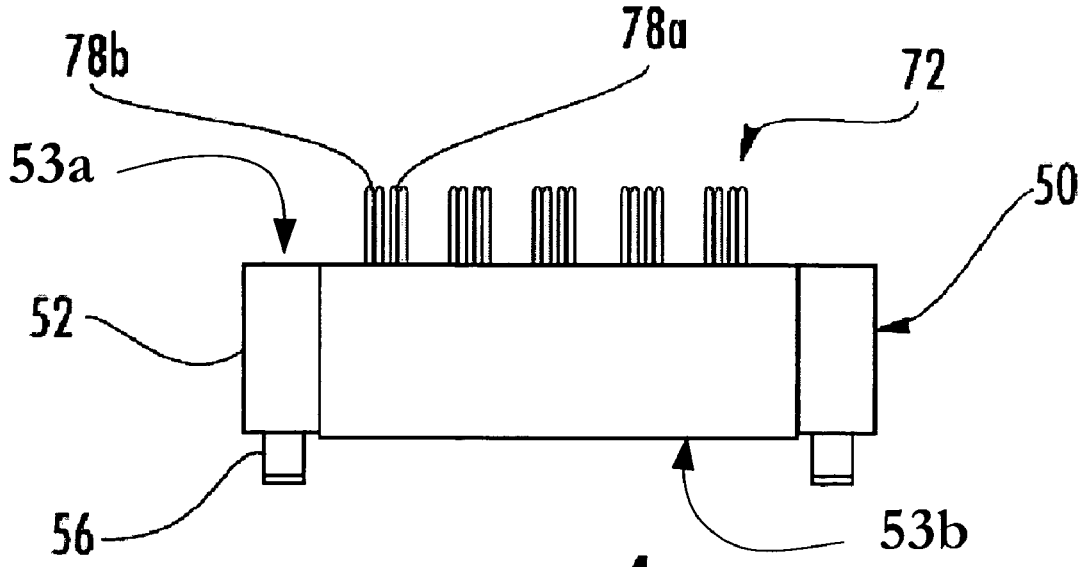
FIG. 4 is a front view of the connector of FIG. 3, as viewed from line 4-4.
Figure 5:
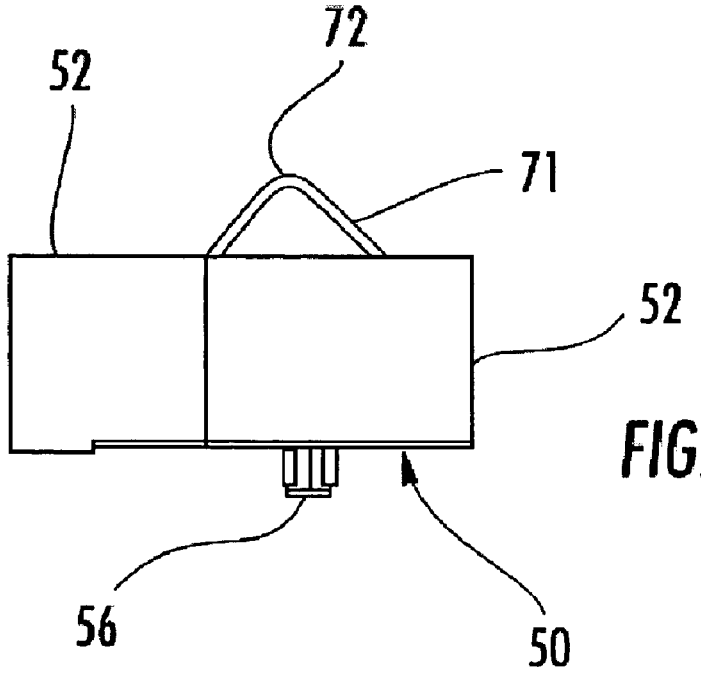
FIG. 5 is a side view of the connector of FIG. 3, as viewed from line 5-5.

As seen in FIGS. 4 and 5, extending below the second side 53*b* is an alignment feature 56, which may be one or more pegs or some type of fastener that can extend through a hole in a PCB and helps ensure the connector 50 is properly aligned with the surface conductors and any associated soldering pads, if provided, on the mounting surface. It should be noted that if the alignment feature 56 is cylindrically shaped, two alignment features may be helpful to control the orientation of the connector 50. Alternatively, one non-symmetrical shaped alignment feature 56 may be sufficient to control the orientation of the connector 50. It should be noted that in an alternative embodiment, not shown, the alignment feature 56 may be a notch or recess in the block 52 that is configured to accept a member or mounting feature extending from the mounting surface.

As depicted in FIGS. 3-7, each conductor 71 includes a contact region 72 and each of the contact regions is bifurcated or split into a first conductor 78*a* and a second conductor 78*b* (FIG. 4). For most common sized connectors 71, bifurcating the conductor 71 into two conductors 78*a* and 78*b* at the contact region 72 is sufficient. However, for larger or stiffer conductors 71 it may be desirable to split the conductor 71 into more than two conductors.

Figure 6:
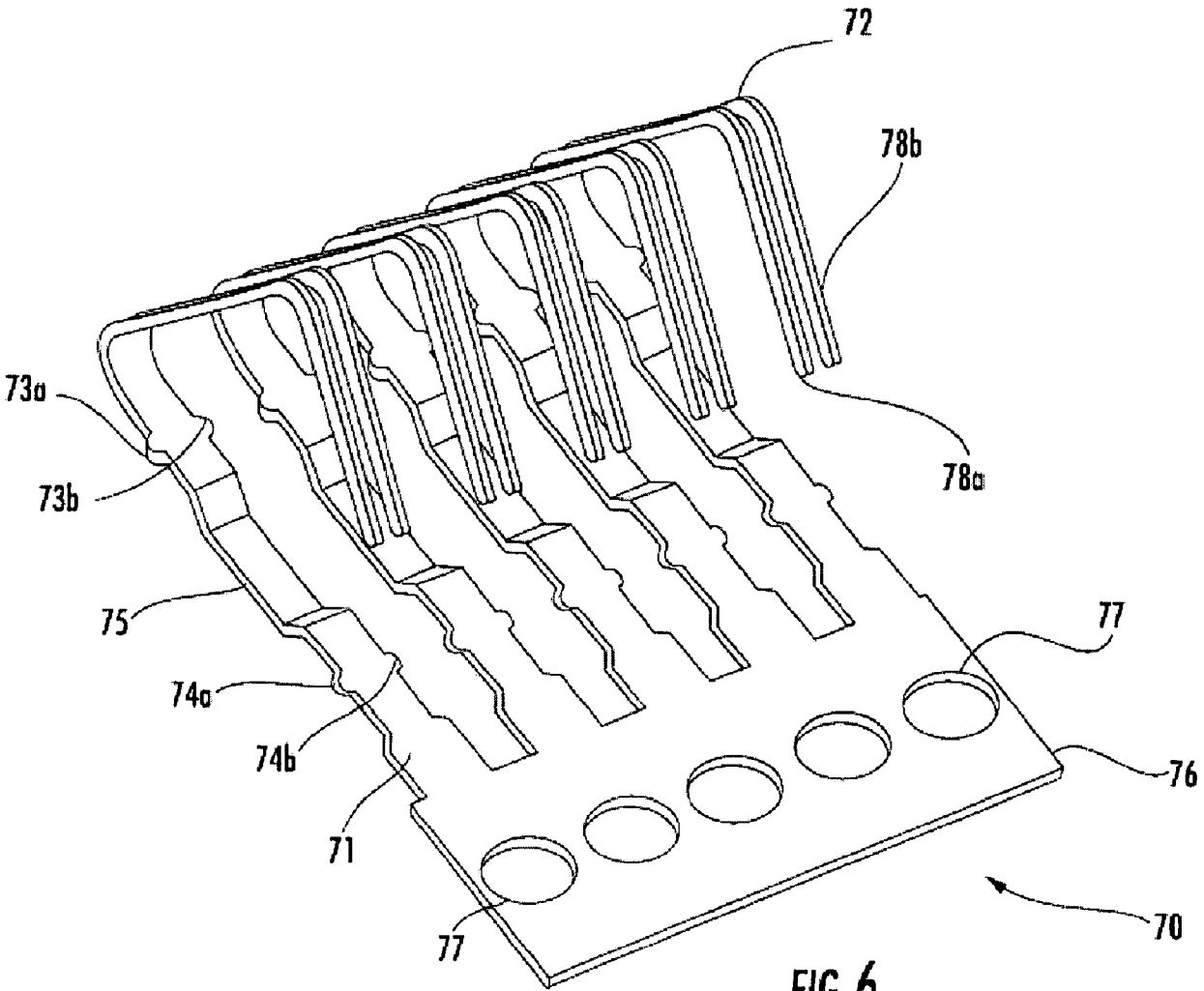
FIG. 6 is an isometric view of an embodiment of a set of stamped conductors mounted to a carrier strip.

To hold the conductors 71 in the channels 55, a retaining feature such as ridges 73*a-b* and 74*a-b* may be provided (FIG. 6). As depicted, the ridges 73*a-b* and 74*a-b* have rounded surfaces so that the conductors 71 are provided with an interference-fit with the channels 55 when installed but do not necessarily gouge or permanently disfigure the connector block 52. It should be noted that the interference fit may be as desired and may depend on the tolerances of the block 52, the channel 55 and the retaining features on the conductors 71, as well as the material properties of same.

Referring to FIG. 6, while not required, to install the conductors 71, the set of conductors 60 may be formed of a single piece of material, which may be a metallic alloy such as steel or aluminum, though a known process such as stamping. The conductors 71 can be shaped through a stamping operation and can be transferred from station to station via a carrier strip 76 with one or more apertures 77 that can be used to help hold and align the carrier strip 76 (and the attached conductors). In an embodiment, the retaining features (such as ridges 73*a-b* which form a first retaining feature and ridges 74*a-b* which form a second retaining feature) may situated in a linear manner with respect to the carrier strip 76 so that the carrier strip 76 and the retaining features form a plane. As can be appreciated, if the retaining features are in line with the carrier strip 76, the carrier strip 76 may be secured and used to push the conductors 71 into the channels 55 with minimum bending forced exerted on the conductors 71. Therefore, it is possible to insert the conductors 71 into the channels 55 without significant deformation of the soldering region 75. It should be noted that as depicted, the soldering region 75 forms a plane substantially parallel to the plane defined by the carrier strip and the retaining features. This alignment, in combination with the rounded retaining features, also helps prevent deformation of the conductors while still provide the desired functionality of an interference fit that holds the conductors 71 in position.

Once the conductors are installed, the carrier strip 76 may be removed and the connector may be mounted to a surface. This can entail placing the soldering region 75 of the conductors 71 on solder pads (not shown) and providing heat energy to solder the soldering regions 75 of the conductors 71 to surface conductors provided on the surface.

Once a connector is mounted to the surface, a mating connector may then be installed on the mounted connector. In an embodiment, the contact region 72 of the conductors 71 of the mounted connector 50 may be somewhat deflected once a mating connector is installed. In an embodiment, the installation of a mating connector may cause the deflection of the conductors 71 to be elastic. As noted above, if the conductor 71 is bifurcated near the contact region 72, the split conductors 78*a*, 78*b* in the contact region 72 can provide additional security into the contact device. For example, vibration can potentially cause an intermittent connection between conductors. The use of the additional conductor (provided by the bifurcation of the conductor 71 near the contact region) preserves the strength of the conductor 71 while doubling the number of contact points and potentially reducing the likelihood of an intermittent connection.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A connector for mounting to a surface, comprising:

a block having a first side, a second side, a third side, a thickness and a shaped perimeter, whereby a mating connector can only be mounted to the connector block in one orientation;

a plurality of channels extending into the third side of the block and spanning the thickness of the block between the first and second side;

a plurality of ribs, wherein each of the plurality of channels is separated from an adjacent channel by one of the plurality of ribs, wherein each of the plurality of ribs is configured to be substantially flush with the second side and to act as a shield for the adjacent channel; and a plurality of conductors positioned in the plurality of channels between the first and second sides, wherein each of the plurality of conductors includes a soldering region proximal the second side and a contact region that is closer to the first side than the soldering region, wherein the soldering region does not extend below the second side nor beyond the third side, and wherein the contact region is split into at least two separate conductors.

2. The connector of claim 1, wherein the soldering region of the conductors is substantially linear and closer to the second side of the block than the remainder of the conductor.

3. The connector of claim 1, wherein the rib extends the thickness of the block and the soldering region of the conductors is positioned a distance from the second surface.

4. The connector of claim 1, wherein the plurality of channels is at least three channels and the plurality of conductors is at least three conductors and the contact region of each conductor is bifurcated into two separate conductors.

5. The connector of claim 1, further comprising an alignment feature for controlling, in operation, alignment of the block with the mounting surface.

6. The connector of claim 5, wherein the alignment feature comprises at least one peg extending from the second surface of the block.

7. The connector of claim 1, wherein the plurality of conductors each includes a first and second retaining feature configured to provide an interference fit between the conductors and an inner surface of the channel and the soldering region is positioned between first and second retaining feature.

8. The connector of claim 7, wherein the solder region is substantially linear and forms a first plane that is substantially parallel to a second plane formed by the first and second retaining feature.

9. A connector system, comprising:

a mounting surface with two surface conductors;

a connector block having a first side, a second side, a third side and a shaped perimeter, whereby a mating connector can only be mounted to the connector block in one orientation, the first side supported by the mounting surface, the block including a first and second channel extending between the first and second side;

a first and second conductor positioned in the first and second channels, the first and second conductors each including a depression region soldered to the one of the two surface conductors and a bifurcated contact region extending from the second side of the block; and a shield extending from the block and positioned between the soldered regions of the first and second conductors, wherein the soldered regions do not extend below the second side nor beyond the third side, and wherein the shield is configured so that, during assembly, the shield and the position of the soldered regions relative to the second and third sides prevent solder from the first conductor from mixing with solder from the second conductor during the soldering of the first and second conductors to the surface conductors.

10. The connector system of claim 9, wherein the connector block includes an alignment feature configured to orient the block with a corresponding alignment feature on the mounting surface.

11. The connector system of claim 9, wherein the mounting surface is a printed circuit board further comprising electrical components in communication with the surface conductors.

12. The connector system of claim 9, wherein the mounting surface includes five surface connectors, the mounting block further includes a third, fourth and fifth channel and a third, fourth and fifth conductor are positioned in the respective channels, wherein each of the five conductors includes the features of the first and second conductor and a shield is provided between each adjacent channel.

* * * * *